US006254414B1

(12) United States Patent
Sawayanagi et al.

(10) Patent No.: US 6,254,414 B1
(45) Date of Patent: Jul. 3, 2001

(54) COUPLING STRUCTURE OF STRUCTURES

(75) Inventors: Masahiro Sawayanagi; Toshiaki Okabe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/643,951

(22) Filed: Aug. 23, 2000

(30) Foreign Application Priority Data

Aug. 26, 1999 (JP) ..... 11-239230

(51) Int. Cl.[7] ..... H01R 13/62
(52) U.S. Cl. ..... 439/310; 439/342
(58) Field of Search ..... 439/310, 342, 439/296, 297, 347, 376

(56) References Cited

U.S. PATENT DOCUMENTS 5,035,634 * 7/1991 Hasircoglu et al. ..... 439/157
5,443,393 * 8/1995 Okumura et al. ..... 439/157
5,727,959 * 3/1998 Yagi et al. ..... 439/157
5,957,710 * 9/1999 Nagano ..... 439/157
6,146,161 * 11/2000 Osawa ..... 439/140

FOREIGN PATENT DOCUMENTS 5-1178 1/1993 (JP) .
5129048 5/1993 (JP) .

* cited by examiner

*Primary Examiner*—Tulsidas Patel
(74) *Attorney, Agent, or Firm*—Armstrong, Westerman, Hattori, McLeland & Naughton, LLP

(57) ABSTRACT

A coupling structure of connectors which comprises a fitting hole 11 formed in a support body 2, a first connector 3 provided on a flux of electric wires extending through the fitting hole, a second connector 5 directly fitted to a mount body 4, and an engagement operating cam member 6 rotatably mounted on either one of the first connector and the second connector and adapted to engage the first connector with the second connector by means of a cam mechanism, and to be inserted into the fitting hole by sliding in a direction intersecting a direction of the engagement by means of a lever crank mechanism.

6 Claims, 18 Drawing Sheets

COUPLING STRUCTURE OF STRUCTURES

BACKGROUND OF THE INVENTION

1. Field of the Invention

The present invention relates to a coupling structure which is utilized for coupling a pair of connectors with each other.

2. Description of the Related Art

Conventionally, there has been proposed a connector housing 90 having a low insertion force as shown in FIG. 22. This connector housing 90 having a low insertion force consists of a first connector housing 91, a second connector housing 92 having a hood 93 for receiving the first connector housing 91, a holder 94 in a shape of a hollow pillar, and two sliders 95, 95 which are movably inserted into the holder 94.

The first connector housing 91 is provided with driven bosses 91*a* in its upper and lower parts. The hood 93 is provided with boss grooves 93*a* in its upper and lower parts respectively. Each of the sliders 95 is provided on its one face with a driving boss 95*a* which moves in the boss groove 93*a,* and on the other face thereof is formed a cam groove 95*b* for guiding the driven boss 91*a*. The holder 94 is provided with introducing grooves 94*a* for guiding the driving bosses 95*a* in its upper and lower parts.

The sliders 95 are mounted on the hood 93 laterally movably, and the driving bosses 95*a* of the sliders 95 are projected from the boss grooves 93*a*. The hood 93 is inserted into one side of the holder 94 while the driving bosses 95*a* are introduced into the guide grooves 94*a*. The driven bosses 91*a* are introduced into the cam grooves 95*b* of the sliders 95 while the first connector housing 91 is inserted into the other side of the holder 94.

As shown in FIG. 23, by pushing the second connector housing 92 into the first connector housing 91, the driving bosses 95*a* are introduced into the guide grooves 94*a* and the boss grooves 93*a*. As the sliders 95 move following the motion, the driven bosses 91*a* are inserted into the cam grooves 93*a*. By pushing the second connector housing 92 into the holder 94 until the driving bosses 95*a* arrive at end edges of the guide grooves 94*a* in this way, the first and the second connector housings 91 and 92 are fitted to each other with a low insertion force.

However, in such a conventional structure, the holder 94 and the two sliders 95, 95 have been necessary in order to connect the first and the second connector housings 91 and 92. Therefore, it has been a problem that components are increased in number incurring an increase of production cost. Further, there has been required a stroke for moving the sliders 95 (moving distance) within the holder 94, and it has been another problem that the first and the second connector housings 91, 92 will become large-sized.

Still further, since the driving bosses 95*a* of the sliders 95 slide in the boss grooves 93*a* of the hood 93, and the driven bosses 91*a* of the first connector housing 91 slide in the cam grooves 95*b* in the sliders 95 respectively, frictional resistance becomes larger during the connection. It has been a drawback that the first and the second connector housings 91, 92 cannot be connected with the low insertion force due to the frictional resistance. In other words, an effect of the low insertion force cannot be obtained as expected.

In view of the above described problems, an object of the invention is to provide a coupling structure of connectors in which number of components can be reduced, a first and a second connectors can be down-sized, and frictional resistance during connection can be decreased.

SUMMARY OF THE INVENTION

In order to attain the above described object, there is provided according to the invention, a coupling structure of connectors which comprises a fitting hole formed in a support body, a first connector provided on a flux of electric wires extending through the fitting hole, a second connector directly fitted to a mount body, and an engagement operating cam member rotatably mounted on either one of the first connector and the second connector and adapted to engage the first connector with the second connector by means of a cam mechanism, and to be inserted into the fitting hole by sliding in a direction intersecting a direction of the engagement by means of a lever crank mechanism.

According to a second aspect of the invention, the engagement operating cam member consists of a first operating lever, and a second operating lever which is rotatably mounted on the first operating lever and combined thereto, the first and second operating levers are provided with follower pins slidably engaged with an inner face of said fitting hole at their respective one ends, and at their respective other ends are provided with elongated cam rotating holes in which engaging pins of one of the connectors are movably engaged, and cam grooves in which cam pins of the other connector are introduced.

According to a third aspect of the invention, an inner wall of the fitting hole is provided with a pair of elongated cam guide holes which are respectively engaged with the follower pins of the first and the second operating levers in a direction intersecting the direction of the engagement, backlash absorbing grooves for absorbing a backlash of the engagement operating cam member which has the backlash are formed in the elongated cam guide holes directed toward the mount body near positions where the follower pins are located at a start of the engagement, and posture correcting slanted faces for pressing the one connector are provided on a housing body of the other connector so as to conduct centering adjustment of the one connector having the backlash.

According to a fourth aspect of the invention, outer levers of the combined first and second operating levers are provided with integral elastic arms so that the first and the second operating levers may be provisionally locked in a state where the cam pins and cam introducing grooves of the cam grooves are opposed, the elastic arms are respectively provided with locking projections at distal ends thereof, and inner levers are provided with locked projections opposing the locking projections.

According to a fifth aspect of the invention, lock release plates are provided in a housing body of the other connector extending in a direction of the engagement for releasing a provisional engagement between the locking projections and the locked projections when the cam pins are introduced into the cam introducing grooves.

According to a sixth aspect of the invention, engaging projections are provided at peripheral edges of other ends of the first and the second operating levers to fix the engagement operating cam member after completion of the engagement, and the housing body of the other connector is provided with elongated locking holes to be locked with the engaging projections when the cam pins have arrived at inner end parts of the cam grooves.

According to the invention, the engagement operating cam member is rotatably mounted on one of the first connector and the second connector and slidable in a direction intersecting the engaging direction. Accordingly, when the engagement operating cam member is operated, the first connector and the second connector are engaged with each other while the engagement operating cam member slides in a direction intersecting the engaging direction by means of a cam mechanism.

According to the second aspect, the engagement operating cam member consists of the first operating lever and the second operating lever. The first operating lever and the second operating lever have follower pins at their respective one ends, and the elongated cam rotating holes and the cam grooves at their respective other ends.

Since the first operating lever is rotatably pivoted on the second operating lever and combined thereto, the first operating lever and the second operating lever rotate with respect to each other around the pivoted point. The follower pins are rotatably and slidably engaged with the inner wall of the fitting hole, and they slide within the fitting hole while rotating. Because the engaging pins of the one connector are movably pivoted in the elongated cam rotating holes, the one connector moves in the engaging direction synchronously with the movements of the engaging pins. Because the cam pins are introduced into the cam grooves, the one and the other connector can be engaged with each other with a low insertion force synchronously with the introduction of the cam pins into the cam grooves.

According to the third aspect, a pair of the elongated cam guide holes to be respectively engaged with the follower pins of the first and the second operating levers are provided at the inner wall of the fitting hole in a direction intersecting the direction of the engagement. The backlash absorbing grooves are formed in the elongated cam guide holes directed toward the mount body near positions where the follower pins are located at a start of the engagement. Moreover, the posture correcting slanted faces for pressing the one connector are provided on the housing body of the other connector so as to conduct centering adjustment of the one connector having the backlash. Accordingly, the one connector having a backlash due to the backlash of the engagement operating cam member is pressed with the posture correcting slanted faces, and the backlash of the engagement operating cam member will be absorbed in the backlash absorbing grooves. In this manner, the centering adjustment of the one connector can be conducted.

According to the fourth aspect, the outer levers of the combined first and second operating levers are provided with the integral elastic arms having respectively provided with the locking projections at the distal ends thereof. The inner levers are provided with the locked projections opposing the locking projections. Accordingly, the first and the second operating levers can be provisionally locked. In this manner, the first and the second operating levers are maintained at rest.

According to the fifth aspect, the lock release plates are provided in the housing body of the other connector extending in a direction of the engagement. Accordingly, when the cam pins are introduced into the cam introducing grooves, the lock release plates are abutted against the locking projections which have been provisionally engaged, and release the provisional engagement between the locking projections and the locked projections. In this manner, the first and the second operating levers will become rotatable when the cam pins are introduced into the cam introducing grooves.

According to the sixth aspect, the engaging projections are provided at the peripheral edges of the other ends of the first and the second operating levers, and the elongated locking holes to be locked with the engaging projections are also provided. Accordingly, when the cam pins have arrived at the inner end parts of the cam grooves, the engagement operating cam member will be fixed to the other connector. In this manner, the engagement operating cam member will be unable to rotate after the completion of the engagement.

DESCRIPTION OF THE PREFERRED EMBODIMENT

Figure 1:
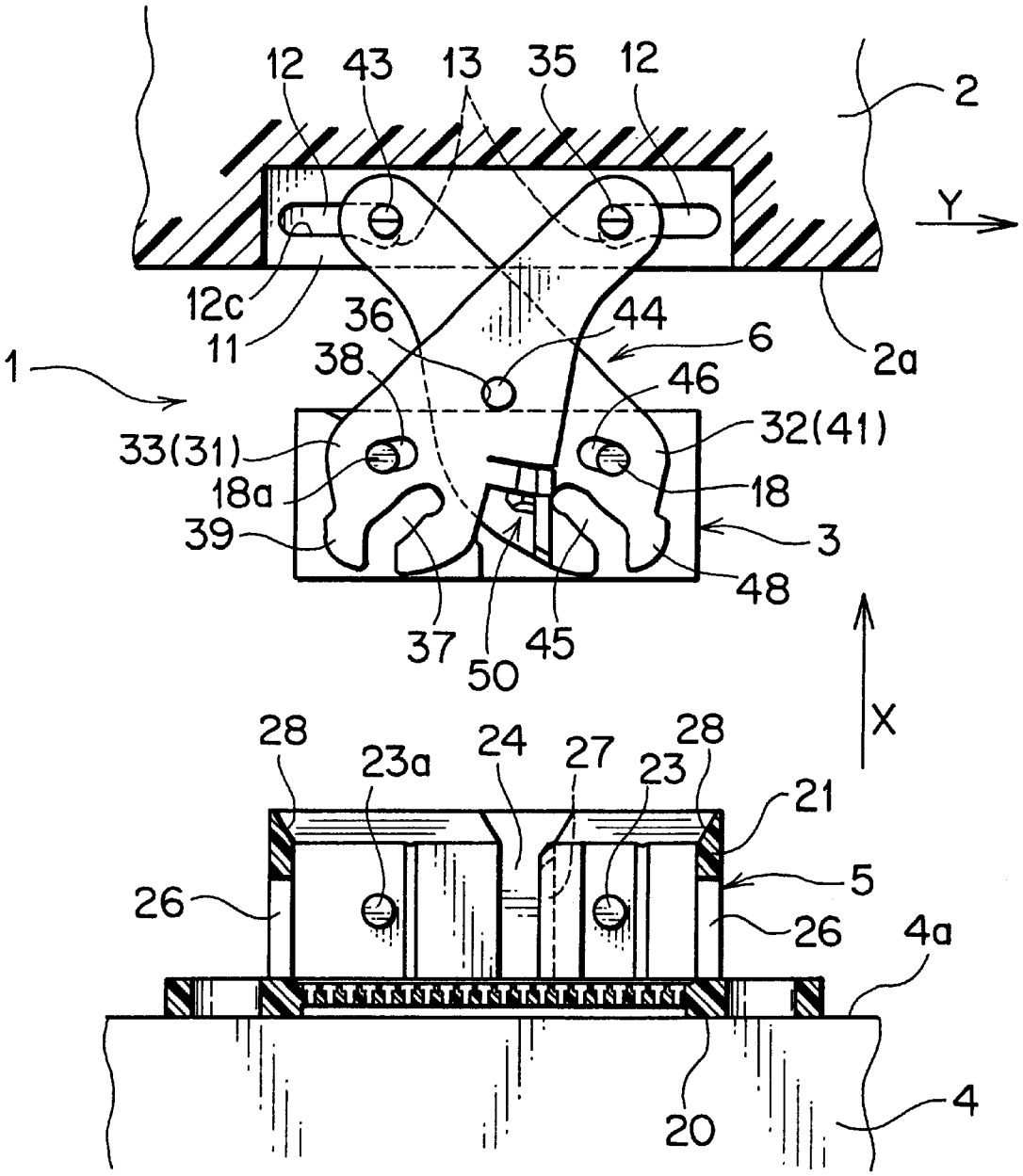
FIG. 1 is an exploded view showing an embodiment of a coupling structure of connectors according to the present invention.

Now, an embodiment of the present invention will be described in detail referring to the drawings.

FIGS. 1 through 21 show an example of a coupling structure of connectors according to the present invention. It is to be noted that a support body in the claims is a vehicle body in the description, a mount body is an apparatus, a first connector is a vehicle side connector of male type, and a second connector is an apparatus side connector of female type. Terminals inserted into the vehicle side connector and the apparatus side connector are omitted in the drawings.

As shown in FIG. 1, this coupling structure 1 of the connectors includes a vehicle side connector 3 mounted on a flux of electric wires (not shown) extending from the vehicle body 2, an apparatus side connector 5 directly fitted to an apparatus 4, and an engagement operating cam member 6 for engaging the vehicle side connector 3 with the apparatus side connector 5 with a low insertion force. The vehicle side connector 3, the apparatus side connector 5 and the engagement operating cam member 6 are formed of insulating resin.

Figure 2:
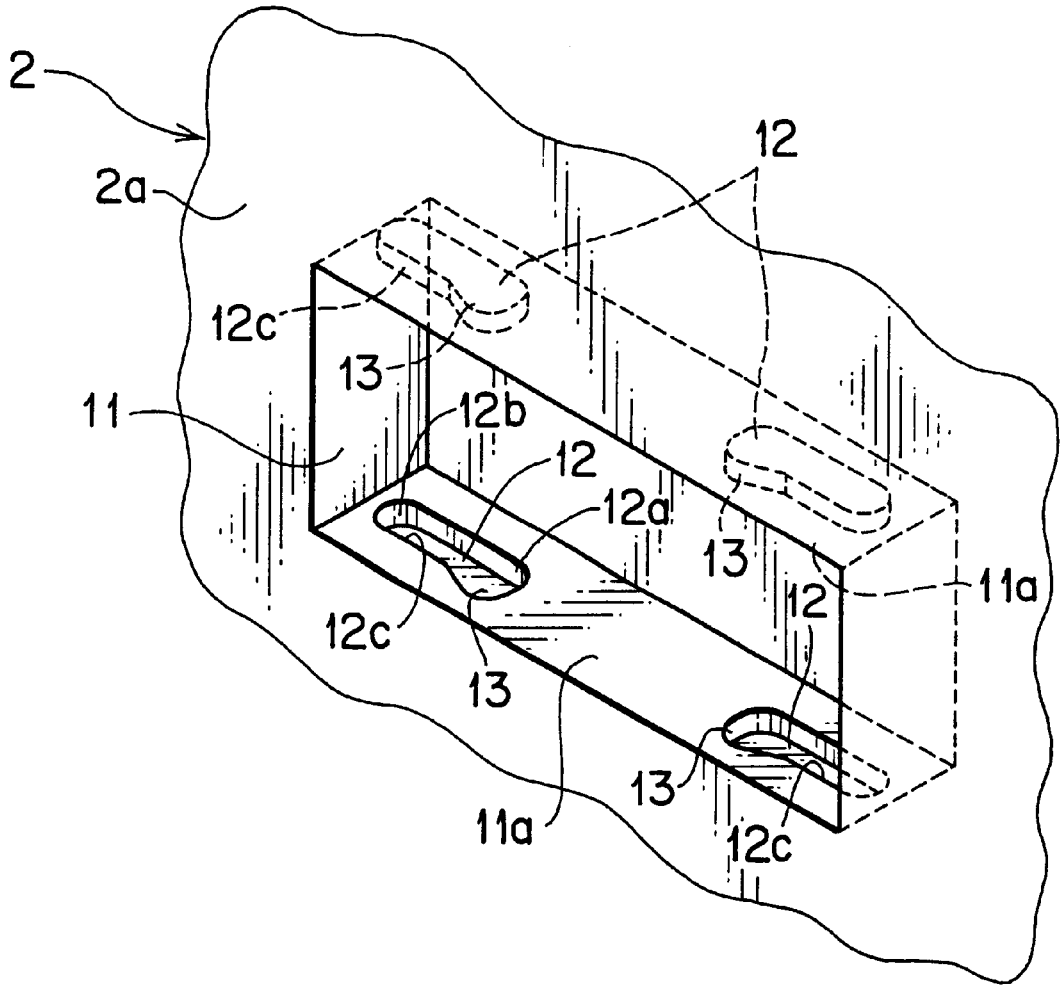
FIG. 2 is an enlarged perspective view of a fitting hole in FIG. 1.

As shown in FIGS. 1 and 2, a panel face 2*a* of the vehicle body 2 is provided with a fitting hole 11. The flux of the electric wires is extended to the exterior through the fitting hole 11, and to an end of the flux is attached the vehicle side connector 3. Opposing walls 11*a*, 11*a* of the fitting hole 11 are respectively provided with a pair of elongated cam guide holes 12 substantially in a line in a direction of an arrow Y which is perpendicular to an engaging direction of an arrow X. A diameter of the cam guide hole 12 is substantially the same as a diameter of follower pins 35, 43 on the engagement operating cam member 6. Each of the cam guide holes 12 has a starting part 12*a* and an end part 12*b*. The starting parts 12*a* in a pair of the cam guide holes 12 are opposed with each other, while the end parts 12*b* are located remote from the starting parts 12*a*.

At the starting part 12*a* of each of the cam guide holes 12 is formed a backlash absorbing groove 13 in a curved shape extending from an inner wall 12*c* of the cam guide hole 12 toward the apparatus 4. A depth of the backlash absorbing groove 13 is smaller than the diameter of the follower pins 35, 43. The backlash absorbing groove 13 serves as a play for the follower pins 35, 43 in the cam guide hole 12. Since at a start of the engagement, the backlash absorbing grooves 13 absorb a backlash of the engagement operating cam member 6, a backlash of the vehicle side connector 3 assembled with the engagement operating cam member 6 can be also absorbed. Centering adjustment of the vehicle side connector 3 can be attained in this manner. The centering adjustment means that a center line (an axis) of the vehicle side connector 3 is set in parallel to the engaging direction (the direction of the arrow X).

Figure 3A:
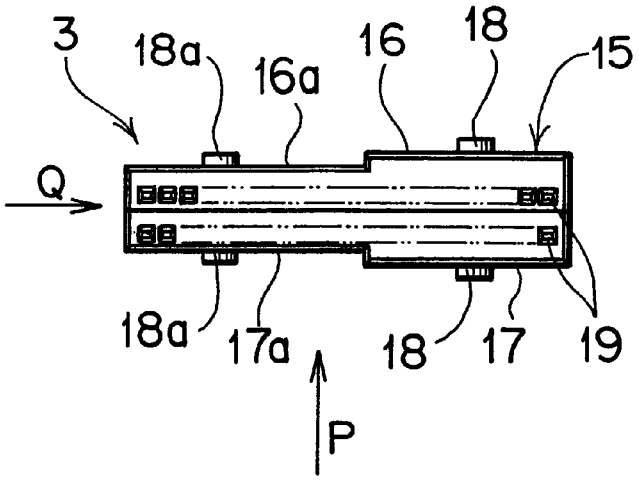
FIG. 3A is a front view of a housing body of a first connector in FIG. 1.
Figure 3B:
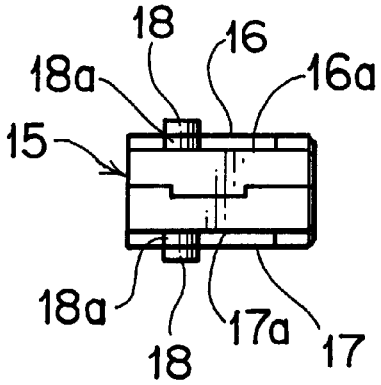
FIG. 3B is a view as seen in a direction of an arrow P in FIG. 3A.
Figure 3C:
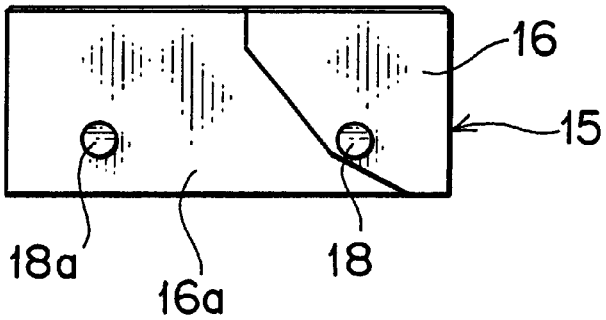
FIG. 3C is a view as seen in a direction of an arrow Q in FIG. 3A.
Figure 4A:
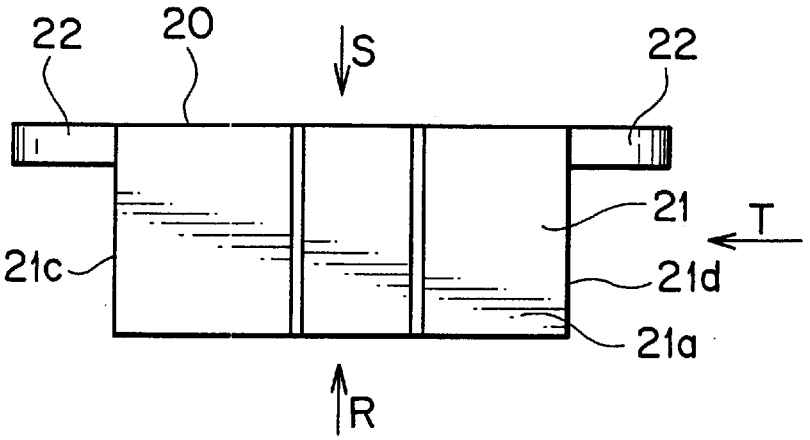
FIG. 4A is a plan view of a housing body of a second connector in FIG. 1.
Figure 4B:
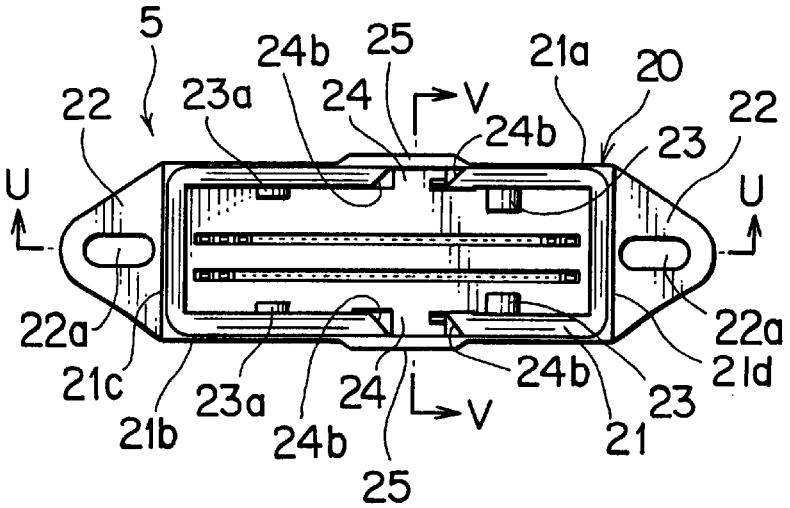
FIG. 4B is a view as seen in a direction of an arrow R in FIG. 4A.
Figure 4D:
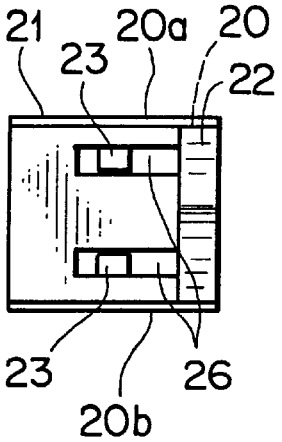
FIG. 4D is a view as seen in a direction of an arrow T in FIG. 4A.
Figure 4C:
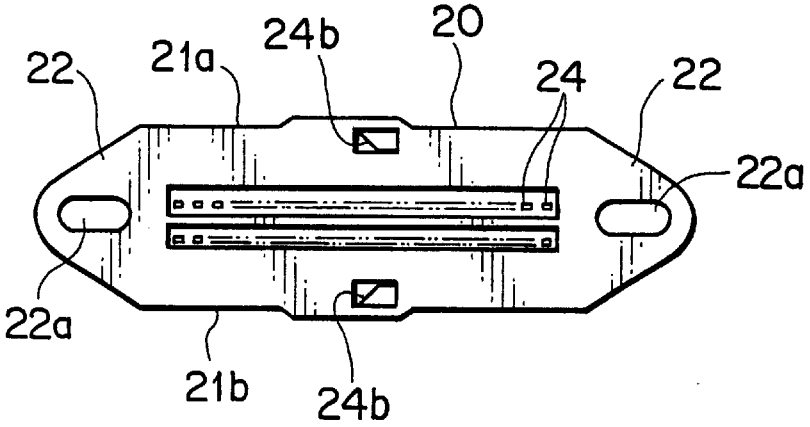
FIG. 4C is a view as seen in a direction of an arrow S in FIG. 4A.

As shown in FIGS. 1 and 3, the vehicle side connector 3 consists of a housing body 15, a stepped upper wall 16*a* formed on an upper wall 16 and a stepped lower wall 17*a* formed on a lower wall 17, and pairs of engaging pins 18, 18*a* respectively provided on the upper walls 16, 16*a* and the lower walls 17, 17*a*.

A plurality of terminal containing chambers 19 are formed passing through the housing body 15. In each of the terminal containing chambers 19 are provided means for locking a female terminal which is not shown. The pairs of the engaging pins 18, 18*a* respectively provided on the upper walls 16, 16*a* and the lower walls 17, 17*a* are arranged substantially in a line in a direction perpendicular to the engaging direction. The engaging pins 18, 18*a* are substantially the same in their projected length. A projected length of the left hand engaging pin 18*a* is substantially the same as a step height of the stepped upper wall 16*a* or the stepped lower wall 17*a*, and therefore, a top end of the left hand engaging pin 18*a* is located in a same plane as the upper wall 16 and the lower wall 17.

Figure 5:
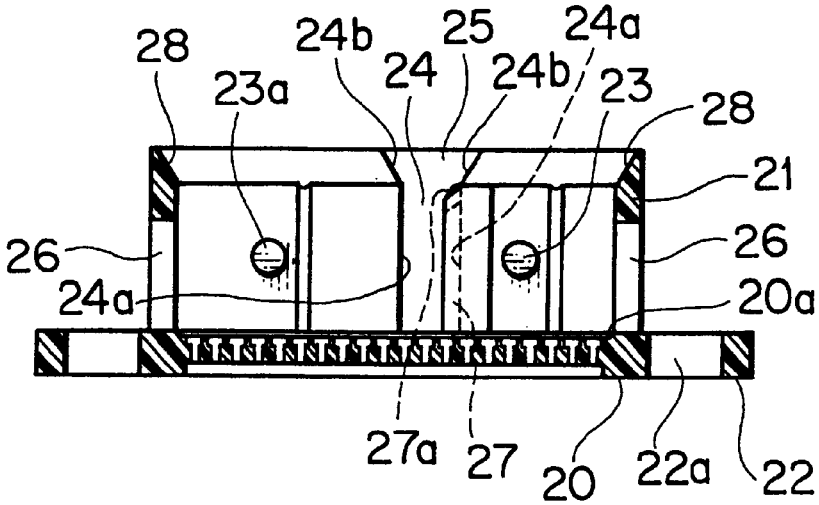
FIG. 5 is a sectional view taken along a line U—U of FIG. 4B.

As shown in FIGS. 1, 4 and 5, the apparatus side connector 5 consists of a housing body 20 including a hood 21, fitting plates 22 extended from the housing body 20, and cam pins 23, 23*a* projecting inward from the hood 21.

A plurality of terminal containing chambers 24 are formed passing through the housing body 20. In each of the terminal containing chambers 24 are provided means for locking a male terminal which is not shown. The terminal containing chambers 19 of the vehicle side connector 3 and the terminal containing chambers 24 of the apparatus side connector 5 correspond to each other one to one.

The cam pins 23, 23*a* are arranged in pairs on an upper wall 21*a* and a lower wall 21*b* of the hood 21 respectively. The left hand cam pins 23*a* on the walls 21*a* and 21*b* are of a same structure, and the right hand cam pins 23 on the walls 21*a* and 21*b* are also of a same structure. Projected distances of both the cam pins 23, 23*a* are substantially the same.

The fitting plates 22 are positioned on the left and the right sides of the housing body 20, and provided with fixing holes 22*a* respectively.

The upper wall 21*a* and the lower wall 21*b* of the hood 21 are provided with rotary shaft receiving grooves 24 substantially in their center parts. Surrounding walls 25 are integrally formed on an outer face of the hood 21 so as to cover the rotary shaft receiving grooves 24 from outside. The rotary shaft receiving grooves 24 are arranged in a direction of inserting the terminals. Opposed groove walls 24*a* of the rotary shaft receiving grooves 24 are respectively provided with slanted faces 24*b*, 24*b* at their forward ends for introducing the rotary shafts. The rotary shaft 44 of the engagement operating cam member 6 is inserted into the rotary shaft receiving grooves 24. The cam pins 23, 23*a* are arranged on both sides of the rotary shaft receiving grooves 24.

A left wall 21*c* and a right wall 21*d* of the hood 21 are respectively provided with pairs of elongated lever locking holes 26, 26 vertically in parallel. The lever locking holes 26, 26 are of a same shape. The lever locking holes 26, 26 in upper parts of the left and the right walls 21*c*, 21*d* are arranged in a straight line by way of the hood 21, and the cam pins 23, 23*a* on the upper wall 21*a* are located in the same straight line. In the same manner, the lever locking holes 26, 26 in lower parts of the left and the right walls 21*c*, 21*d* are arranged in a straight line by way of the hood 21, and the cam pins 23, 23*a* on the lower wall 21*b* are located in the same straight line.

Figure 6:
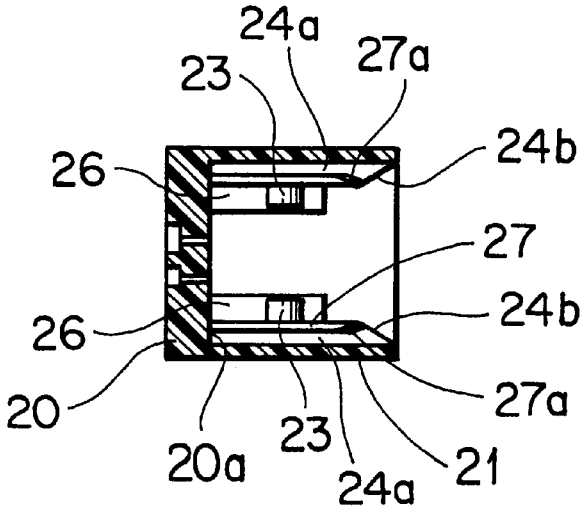
FIG. 6 is a sectional view taken along a line V—V of FIG. 4B.
Figure 7A:
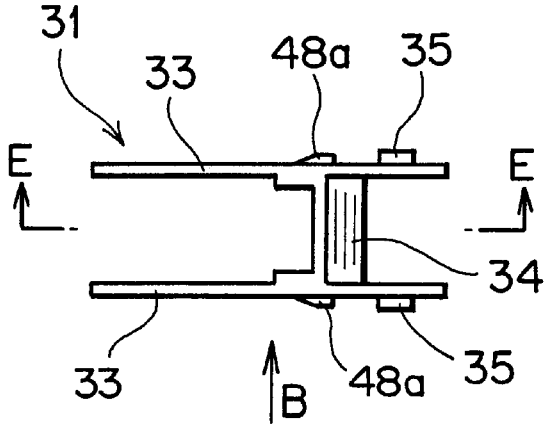
FIG. 7A is a front view of a first operating lever of FIG. 1.
Figure 7D:
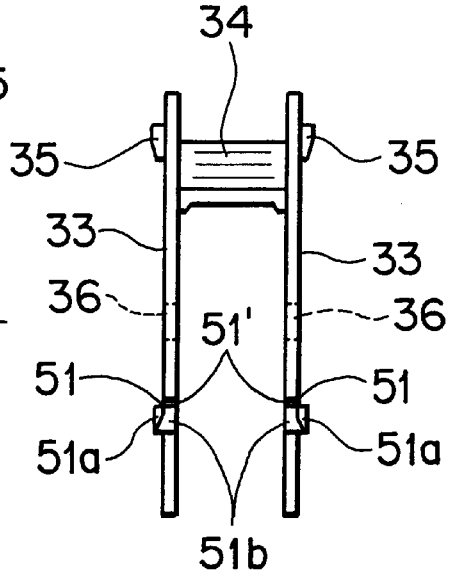
FIG. 7D is a view as seen in a direction of an arrow D in FIG. 7B.
Figure 7B:
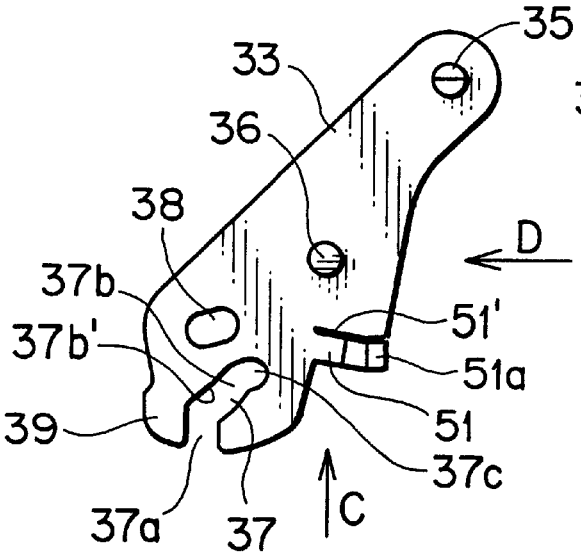
FIG. 7B is a view as seen in a direction of an arrow B in FIG. 7A.
Figure 7C:
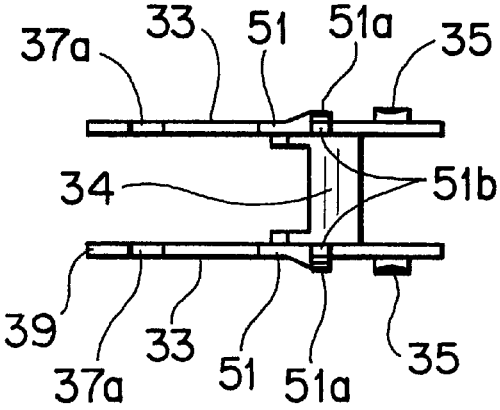
FIG. 7C is a view as seen in a direction of an arrow C in FIG. 7B.

As shown in FIGS. 1, 5 and 6, a lock release plate 27 is provided in each of the rotary shaft receiving grooves 24 extending from a front end face 20*a* of the housing body 20 in the terminal insertion direction. The lock release plate 27 lies on the right side wall 24*a* of the rotary shaft receiving groove 24. A distal end of the lock release plate 27 and a backward end of the slanted face 24*b* are positioned in a same plane. A slanted lock release face 27*a* is formed at a distal end of the lock release plate 27 in a rightwardly ascending manner.

At forward end portions of the left wall 21*c* and the right wall 21*d* of the hood 21, are respectively formed slanted faces 28 for posture correction. When the vehicle side connector 3 is in an incorrect position (with a backlash) with respect to the apparatus side connector 5, the posture correcting slanted face 28 will correct the vehicle side connector 3 from the incorrect position to a correct position by means of the posture correcting slanted faces 28.

As shown in FIG. 1, the engagement operating cam member 6 consists of a first operating lever 31, and a second operating lever 32 which is rotatably mounted on the first operating lever 31 and coupled with the first operating lever 31.

Figure 8:
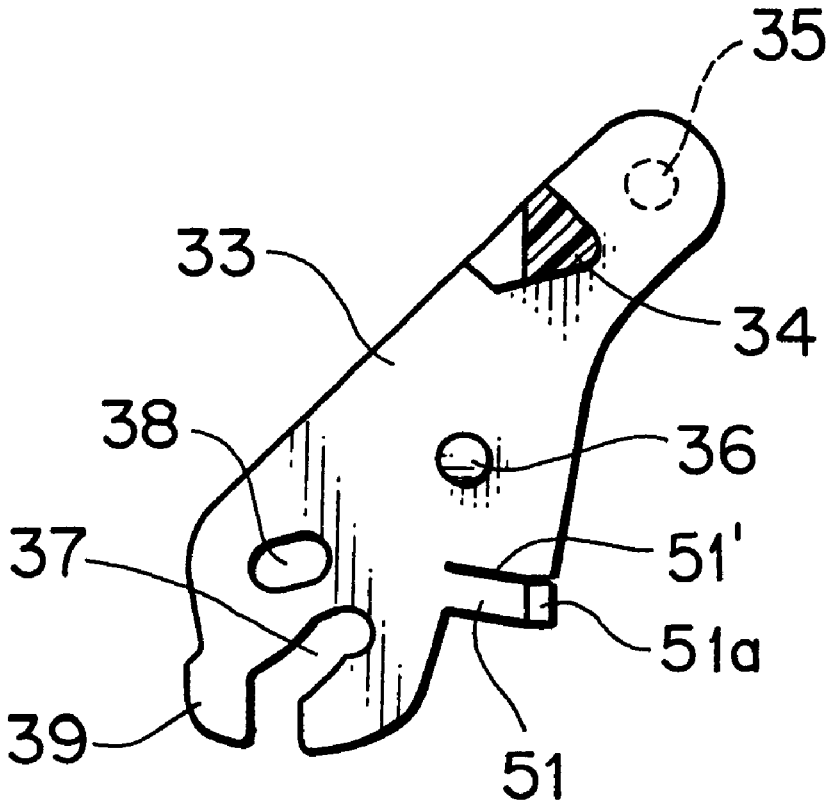
FIG. 8 is a sectional view taken along a line E—E of FIG. 7A.
Figure 9A:
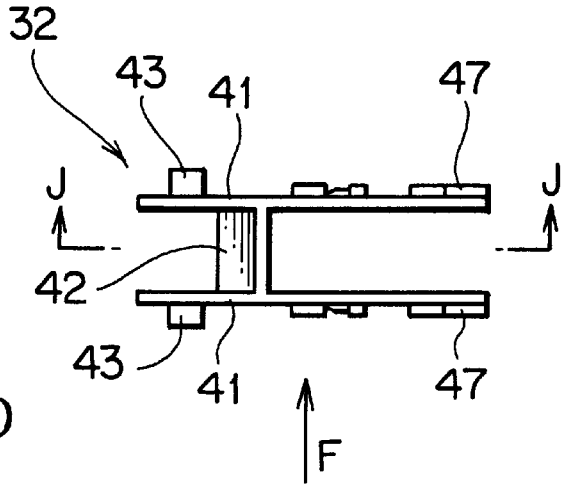
FIG. 9A is a front view of a second operating lever of FIG. 1.
Figure 9D:
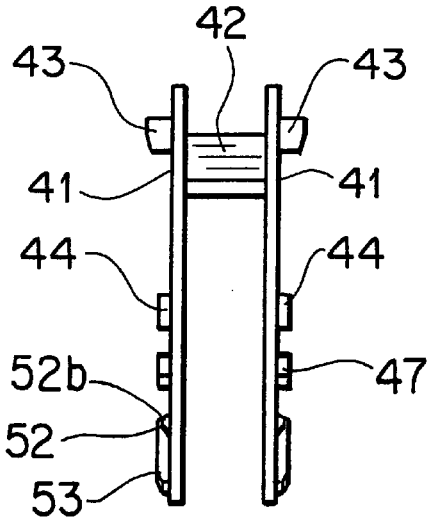
FIG. 9D is a view as seen in a direction of an arrow H in FIG. 9B.
Figure 9B:
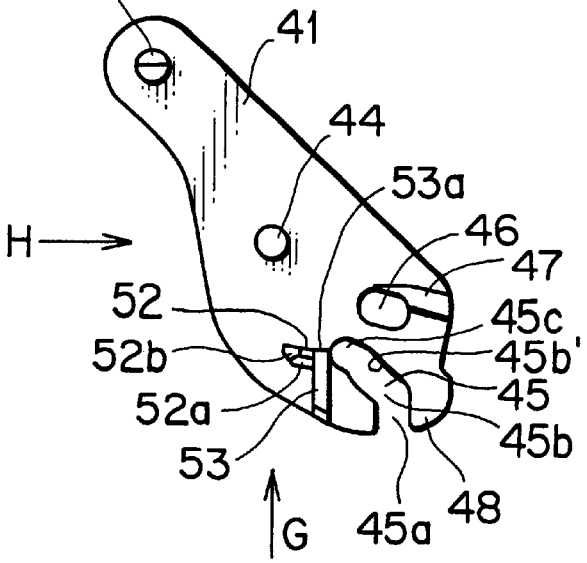
FIG. 9B is a view as seen in a direction of an arrow F in FIG. 9A.
Figure 9C:
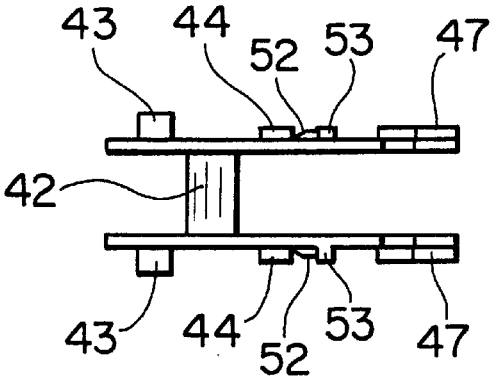
FIG. 9C is a view as seen in a direction of an arrow G in FIG. 9B.

As shown in FIGS. 1, 7 and 8, the first operating lever 31 includes a pair of first operating plates 33, 33 in a shape of a sole and a connecting support plate 34 bridging a pair of the first operating plates 33, 33. Each of the first operating plates 33 is provided with a follower pin 35 projecting outward at its one end, a shaft hole 36 in its intermediate part, and a cam groove 37 at its other end. An elongated cam rotating hole 38 is formed near the cam groove 37. At a periphery of the first operating plate 33 is provided an engaging projection 39, with which the lever locking hole 26 of the apparatus side connector 5 is adapted to engage.

The cam groove 37 includes a cam introducing groove 37*a*, a cam guide groove 37*b* communicating with the cam introducing groove 37*a*, and an inner end part 37*c* at a deeper position than the cam guide groove 37*b*. The cam introducing groove 37*a* is in parallel to the terminal insertion direction when the first and the second operating levers 31 and 32 are provisionally engaged. The cam pins 23, 23*a* slide along an introducing slide face 37*b*′ of the cam guide groove 37*b* by a rotation of the first operating lever 31.

Figure 10:
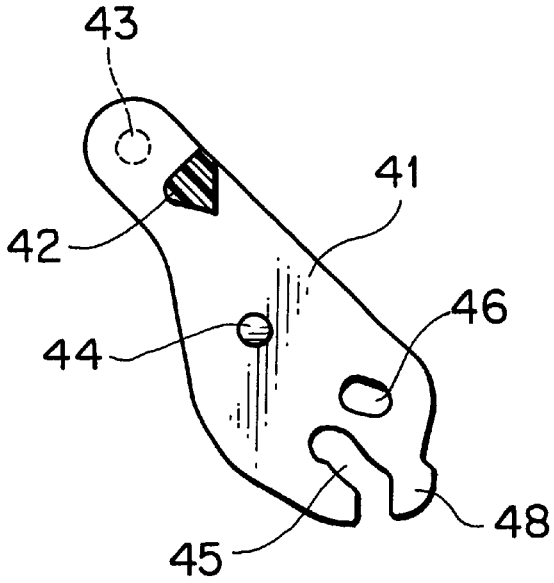
FIG. 10 is a sectional view taken along a line J—J of FIG. 9A.

As shown in FIGS. 1, 9 and 10, the second operating lever 32 is slightly smaller than the first operating lever 31. The second operating lever 32 includes a pair of second operating plates 41, 41 in a shape of a sole and a connecting support plate 42 bridging a pair of the second operating plates 41, 41.

As shown in FIGS. 9 and 10, each of the second operating plates 41 is provided with a follower pin 43 projecting outward at its one end, a rotary shaft 44 at its intermediate part, and a cam groove 45 at its other end in the same manner as the first operating lever 31. An elongated cam rotating hole 46 is formed near the cam groove 45. A rib-like stopper 47 is provided adjacent to the elongated cam rotating hole 46 projecting outward in order to prevent an excessive rotation of the first operating lever 31 with respect to the second operating lever 32 after completion of the engagement. At a periphery of the second operating plate 41 near the elongated cam rotating hole 46 is provided an engaging projection 48. A shape of the cam groove 45 is substantially the same as in the first operating plate 33 (refer to FIG. 7), and an explanation thereof will be omitted. Numerals 45*a*, 45*b*, 45*c*, and 45*b*′ designate a cam introducing groove, a cam guide groove, an inner end part, and an introducing slide face, respectively.

As shown in FIG. 1, the rotary shaft 44 of the second operating lever 32 is rotatably inserted into the shaft hole 36 of the first operating lever 31. Accordingly, the first and the second operating levers 31, 32 can be rotated independently from each other around the rotary shaft 44.

Provisional locking means 50 are provided between the first operating plate 33 and the second operating plate 41, at an area where they are overlapped when the cam introducing grooves 37*a* and 45*a* are in an opposed state with the cam pins 23 and 23*a* respectively.

As shown in FIGS. 1, 7 and 9, the provisional locking means 50 consist of an elastic arm 51 integrally formed on the first operating plate 33, and a locked projection 52 integrally formed on an outer face of the second operating plate 41.

The elastic arm 51 is flexibly formed by making a slit 51′ in the first operating plate 33 at an opposite side to the elongated cam rotating hole 38 with respect to the cam groove 37. A locking projection 51*a* is integrally formed at a distal end of the elastic arm 51. The locking projection 51*a* is formed it its lower half part with an insertion cut-out 51*b* having a size substantially equal to a thickness of the first operating plate 33.

The locked projection 52 is integrally formed on the outer face of the second operating plate 41. The locked projection 52 includes an inclined releasing face 52*a* and an inclined arm guide face 52*b*. The inclined releasing face 52*a* is located at a side where the engagement between the vehicle side connector 3 and the apparatus side connector 5 is released. The inclined arm guide face 52*b* is located at an opposite side to the cam groove 45. Accordingly, the elastic arm 51 which has overridden the locked projection 52 after the provisional engagement had been released is smoothly guided to the outer face of the second operating plate 41. On the contrary, when the first and the second operating levers 31, 32 are shifted again to the provisionally engaged state, the elastic arm 51 can easily override the locked projection 52 by means of the inclined arm guide face 52*b* thereby to provisionally engage with the locked projection 52.

Moreover, an engaging rib 53 is projectingly formed substantially perpendicular to the locked projection 52 and connected thereto. A projected length of the engaging rib 53 is substantially equal to a projected length of the locking projection 51*a*. A distal end 53*a* of the engaging rib 53 is engaged with the engaging projection 51*a* of the elastic arm 51.

Now, a method of coupling the vehicle side connector 3 and the apparatus side connector 5 as shown in FIG. 1 will be explained. The female terminals and the male terminals in both the connectors 3 and 5 are omitted from the explanation.

The explanation will be made with reference to a case where the vehicle side connector 3 is provided at the end of the flux of the electric wires extending through the fitting hole 11 in the vehicle body 2, and the apparatus connector 5 is directly coupled to the wall 4*a* of the apparatus 4, as shown in FIG. 1. However, the explanation can be also applied to other cases.

The rotary shaft 44 of the second operating lever 32 is pivotally inserted into the shaft hole 36 of the first operating lever 31 thereby to constitute the engagement operating cam member 6. On this occasion, inner faces of a pair of the first operating plates 33, 33 are in contact with outer faces of a pair of the second operating plates 41, 41 respectively. The follower pins 35, 43 of the engagement operating cam member 6 are slidably inserted into the elongated cam guide holes 12, 12 and the engaging pins 18, 18*a* of the vehicle side connector 3 are pivotally inserted into the elongated cam rotating holes 38, 46 of the engagement operating cam member 6.

With the follower pins 35, 43, and the engaging pins 18, 18*a,* movements of the engagement operating cam member 6 in an engaging direction of the arrow X and in a direction of the arrow Y perpendicular to the engaging direction will be respectively restricted. The movements of the cam member 6 in the direction of the arrow X and in the direction of the arrow Y are synchronous. A cam mechanism is composed of the engaging pins 18, 18*a* in cooperation with the elongated cam rotating holes 38, 46, and the cam pins 23, 23*a* in cooperation with the cam grooves 37, 45. A lever crank mechanism is composed of the follower pins 35, 43 in cooperation with the elongated cam guide holes 12, 12.

Figure 11:
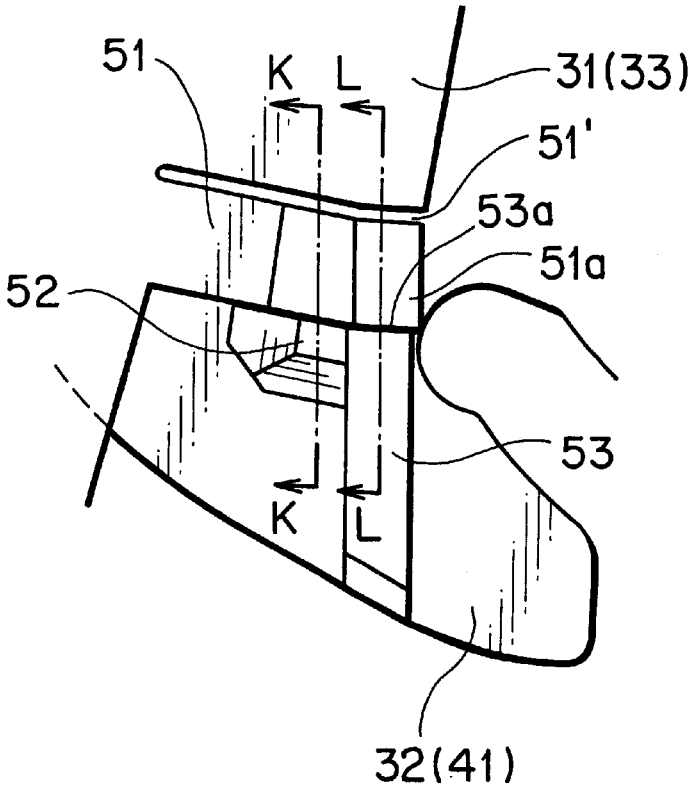
FIG. 11 is a view for explaining a provisional engagement between the first operating lever and the second operating lever in FIG. 1.
Figure 12A:
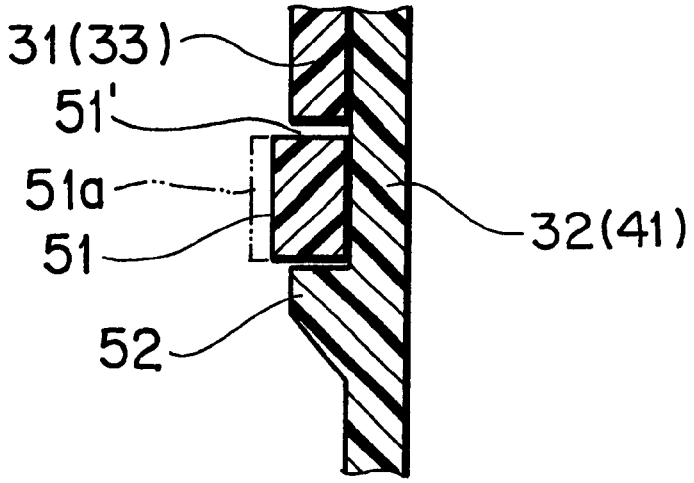
FIG. 12A is a sectional view taken along a line K—K of FIG. 11.
Figure 12B:
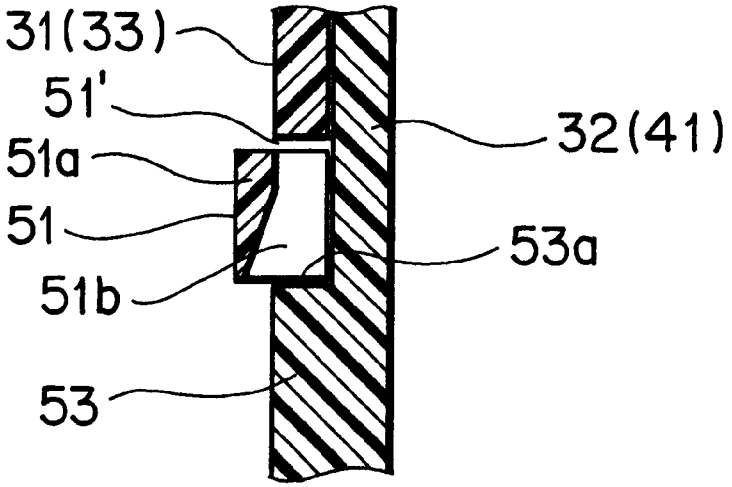
FIG. 12B is a sectional view taken along a line L—L of FIG. 11.

The follower pins 35, 43 are slid into the starting part 12*a,* 12*a* of the elongated cam guide holes 12, 12 as shown in FIG. 1, or the engaging pins 18, 18*a* are rotated within the elongated cam rotating holes 38, 46. The inner faces of the first operating plates 33 slide along the outer faces of the second operating plates 41. As shown in FIGS. 11 and 12, each of the elastic arms 51 of the first operating plates 33 is provisionally engaged with each of the locked projections 52 of the second operating plates 41, while the locking projection 51*a* of the elastic arm 51 is provisionally locked with the distal ends 53*a* of each of the engaging ribs 53. In other words, the first and the second operating plates 33 and 41 are provisionally engaged with each other. On this occasion, the locking projection 51*a* is provisionally locked with the locked projection 52 in such a manner as projecting from the outer face of the first operating plate 33. In this way, the cam introducing grooves 37*a,* 45*a* can be easily opposed with the cam pins 23, 23*a*.

In a state where the engagement operating cam member 6 is provisionally locked, the apparatus side connector 5 is moved toward the vehicle side connector 3.

Figure 13:
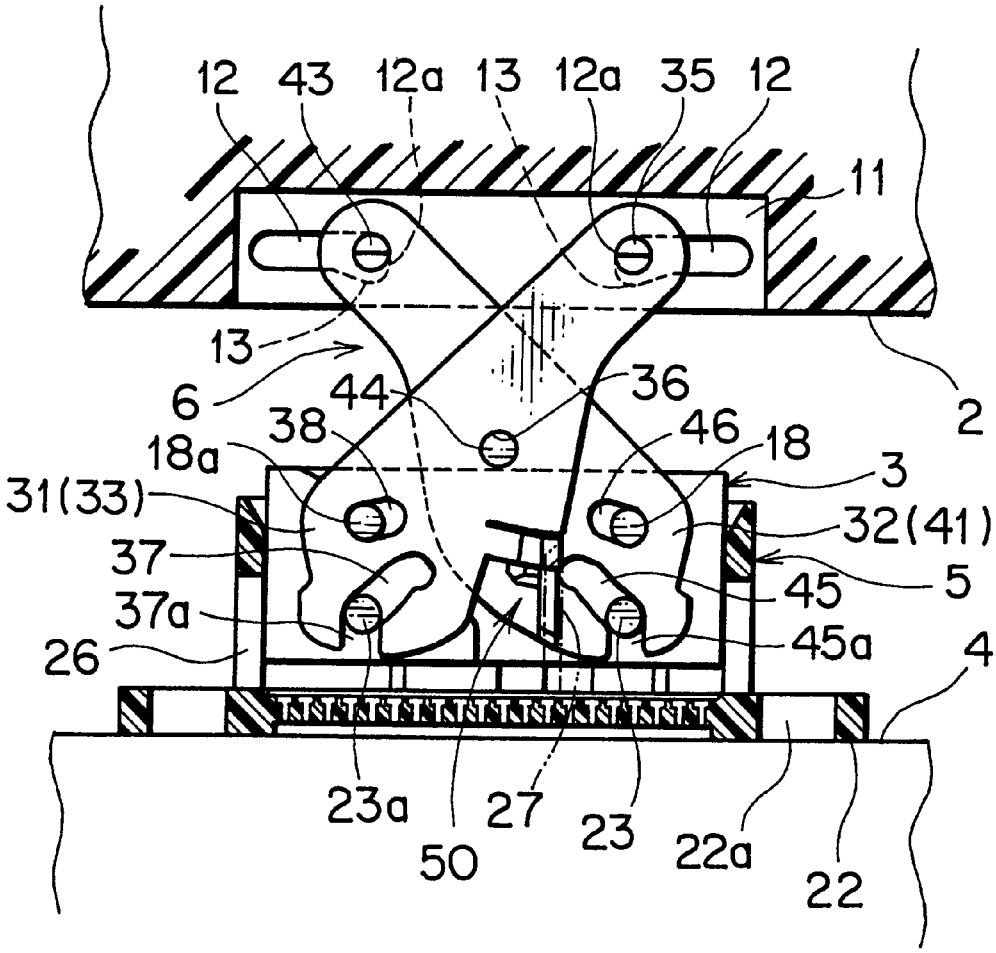
FIG. 13 is a view for explaining a state wherein cam pins are introduced into cam introducing grooves during a provisional engagement between the first operating lever and the second operating lever in FIG. 1.

As shown in FIG. 13, when the cam introducing grooves 37*a,* 45*a* are opposed with the cam pins 23, 23*a,* the cam pins 23, 23*a* are automatically introduced into the cam introducing grooves 37*a,* 45*a* as the apparatus connector 5 is inserted into the vehicle side connector 3.

Figure 14:
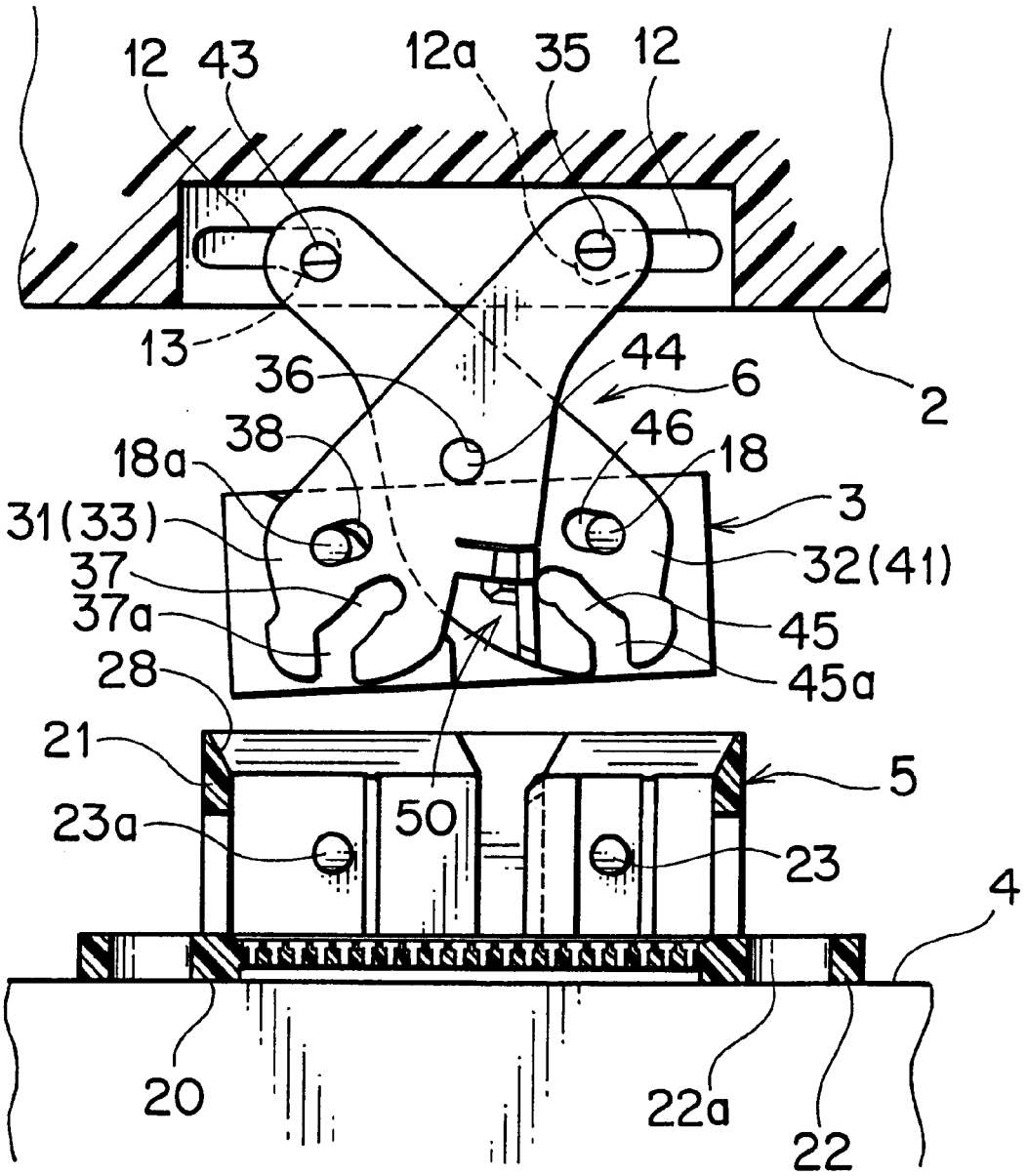
FIG. 14 is a view for explaining a state wherein the first connector is inclined with respect to the second connector because the first operating lever and the second operating lever have provisionally engaged with a backlash in FIG. 1.
Figure 15:
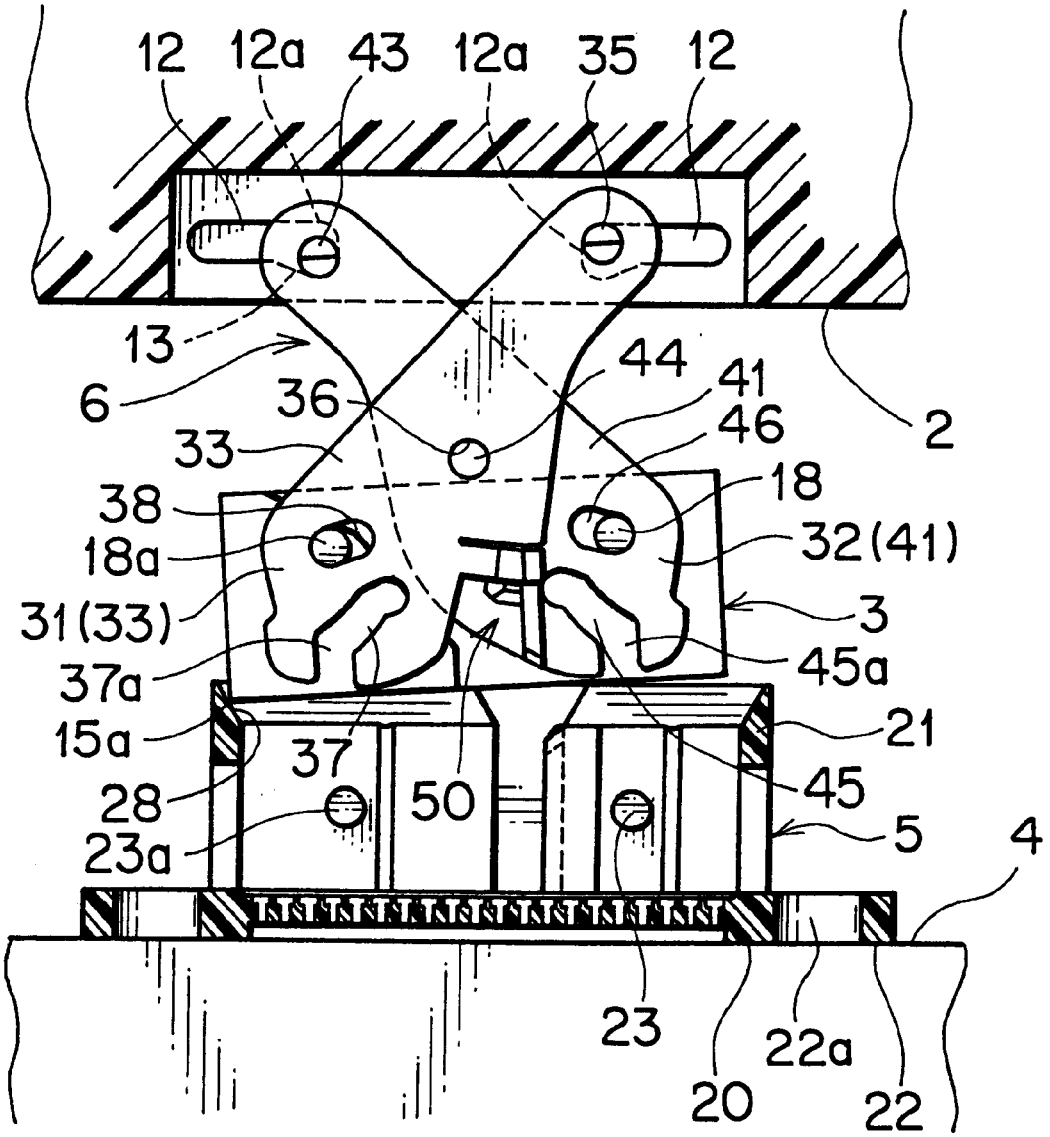
FIG. 15 is a view for explaining a state wherein a posture of the first connector is corrected by means of the second connector in FIG. 14.

In case where the engagement operating cam member 6 is irregularly positioned with a backlash as shown in FIG. 14, the follower pin 35 is arranged in the starting part 12*a* of the elongated cam guide hole 12 and the other follower pin 43 is arranged in the backlash absorbing groove 13. In this case, the cam introducing grooves 37*a,* 45*a* are not opposed with the cam pins 23, 23*a*. However, by pushing the apparatus side connector 5 toward the vehicle side connector 3 as shown in FIG. 15, the posture correcting face 2 formed on the hood 21 of the apparatus side connector 5 abuts against the forward end periphery 15*a* of the vehicle side connector 3. As the apparatus side connector 5 is pushed in, the other follower pin 43 is moved from the backlash absorbing groove 13 into the elongated cam guide hole 12. Accordingly, the other follower pin 43 can be also arranged in the starting part 12*a* of the cam guide hole 12. Thus, the cam introducing grooves 37*a,* 45*a* can be opposed with the cam pins 23, 23*a*. In other words, the cam member 6 and the vehicle side connector 3 can be centered with respect to the apparatus side connector 5.

Figure 16:
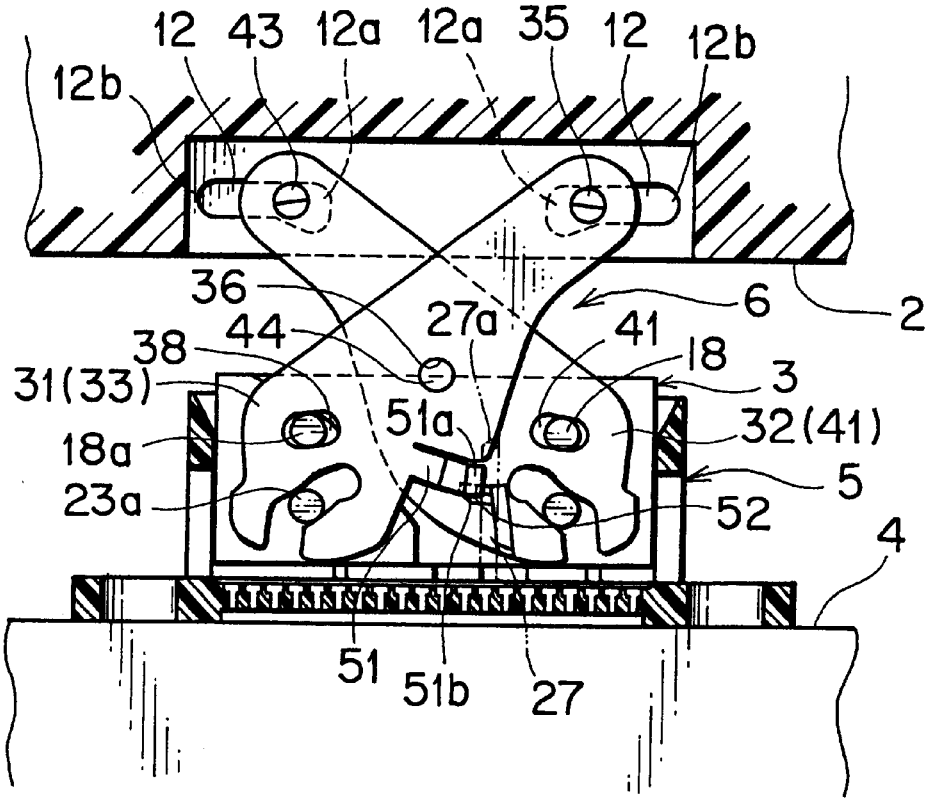
FIG. 16 is a view for explaining a state wherein the provisional engagement between the first operating lever and the second operating lever in FIG. 13 is released and cam pins are introduced into cam introducing grooves by pushing the second connector into the first connector.
Figure 17:
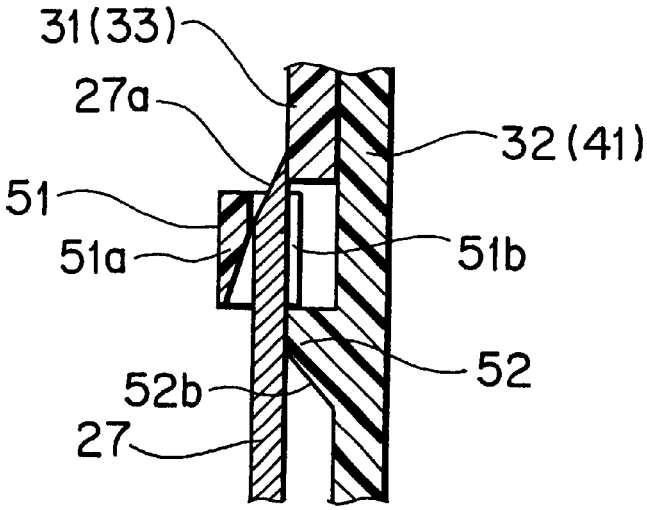
FIG. 17 is a view for explaining a state wherein a locking projection of the first operating lever is lifted by a lock release plate of the second connector by pushing the second connector into the first connector in FIG. 16.
Figure 18:
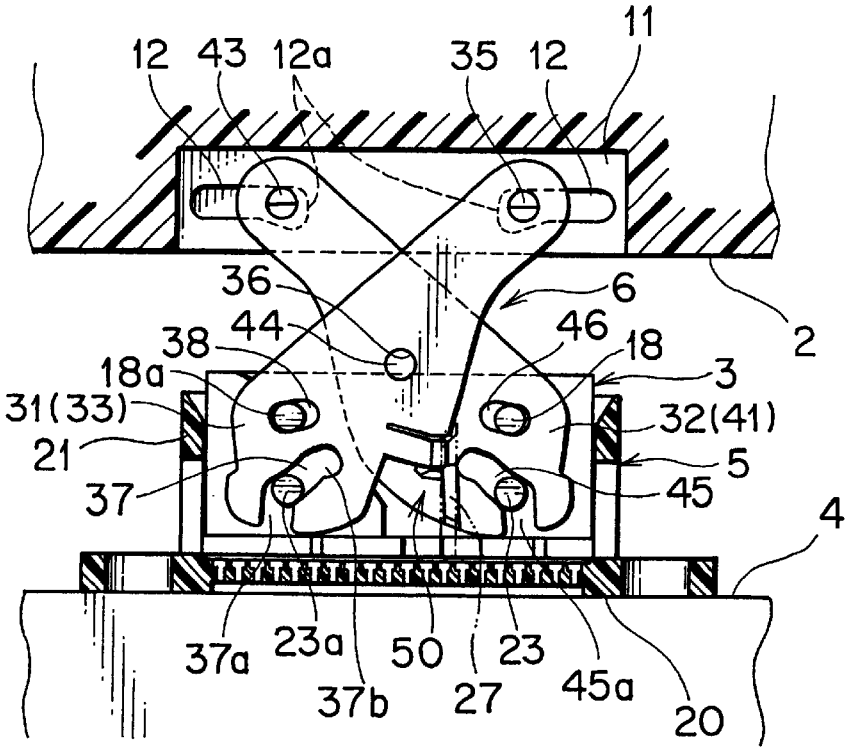
FIG. 18 is a view for explaining a state wherein the locking projection of FIG. 17 overrides the locked projection.

When the apparatus side connector 5 is further pushed in as shown in FIGS. 16 and 17, the cam pins 23, 23*a* are inserted into the cam guide grooves 37*b,* 45*b* from the cam introducing grooves 37*a,* 45*a*. Immediately after the cam pins 23, 23*a* are inserted into the cam guide grooves 37*b,* 45*b,* each of the lock release plates 27 of the apparatus side connector 5 is pushed into an insertion cut-out 51*b* below the locking projection 51*a* through the lock release face 27*a*. As the locking projection 51*a* is lifted upward by means of the lock release plate 27, the elastic arm 51 is also lifted up. As the locking projection 51*a* overrides the locked projection 52 as shown in FIGS. 17 and 18, the provisional engagement between the first and the second operating levers 31, 32 is released. The lock release plates 27 slide along the outer faces of the first operating plates 33, 33. When the provisional engagement between the first and the second operating levers 31, 32 is released, the locked projections 52 and the engaging ribs 53 formed on a pair of the second operating plates 41, 41 will not contact the outer face of the first operating plates 33.

As the apparatus side connector 5 is pushed into the vehicle side connector 3 after the release of the provisional engagement, the follower pins 35, 43 are moved from the starting parts 12*a* of the cam guide holes 12, 12 toward the end parts 12*b* respectively, and the engaging pins 18, 18*a* are moved from the starting parts 38*a,* 46*a* toward the end parts 38*b,* 46*b* respectively. In this way, the first and the second operating levers 31, 32 start to be received in the fitting hole 11, and the cam pins 23, 23*a* start to be introduced into the cam guide grooves 37*b,* 45*b*.

Figure 19:
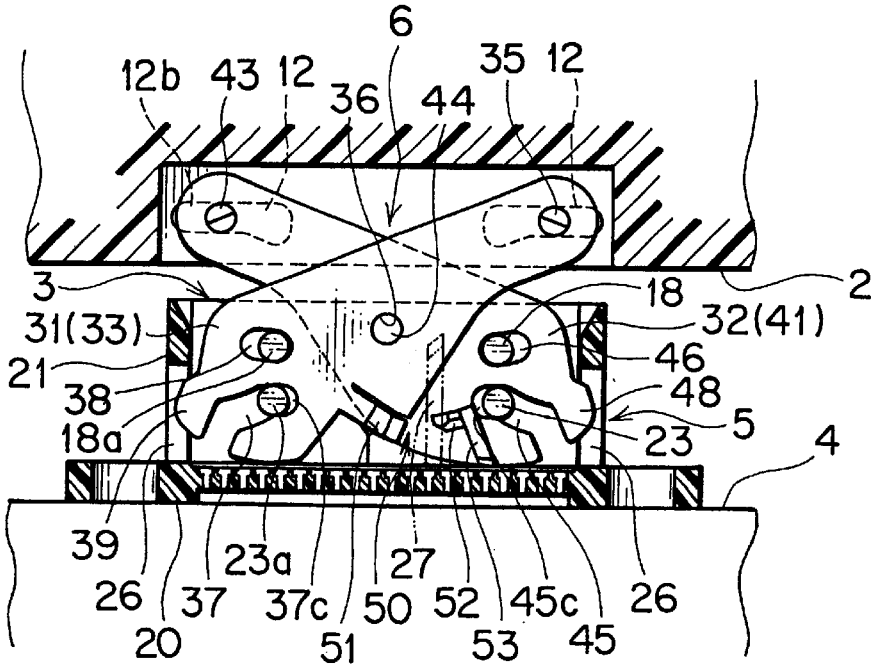
FIG. 19 is a view for explaining a state wherein the locking projection of FIG. 18 has completely overridden the locked projection to bring the first and the second connectors in the engaged state.

As shown in FIG. 19, just before the cam pins 23, 23*a* arrive at the inner end part 37*c,* 45*c* of the cam grooves 37, 45, the vehicle side connector 3 and the apparatus side connector 5 are engaged with each other with a low insertion force by means of the engagement operating cam member 6.

Figure 20:
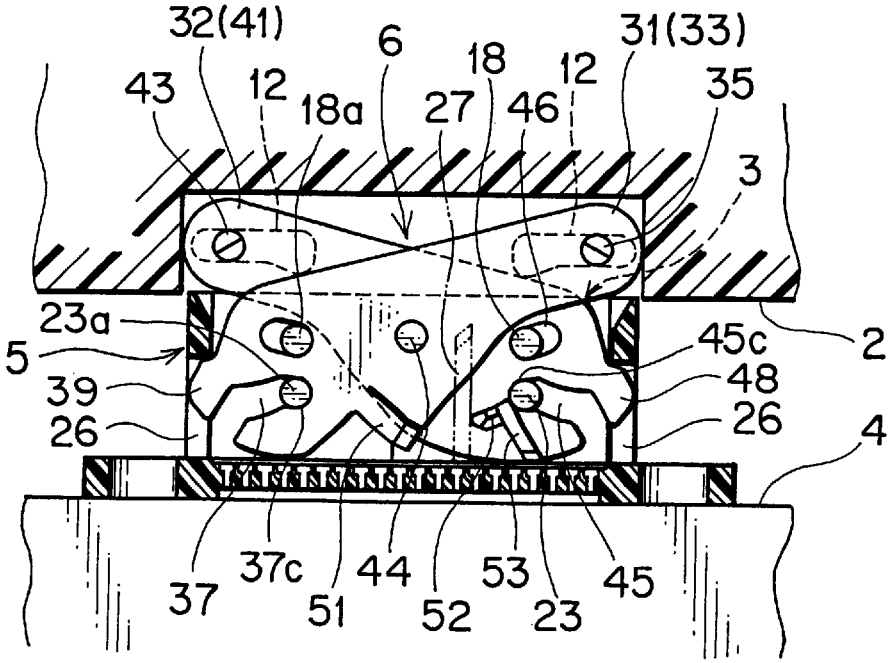
FIG. 20 is a view for explaining a state wherein by further pushing the second connector into the first connector from the state in FIG. 19, engaging projections of the first operating lever and the second operating lever are engaged with elongated lever locking holes, and cam pins have arrived substantially at inner end parts of the cam grooves.
Figure 21:
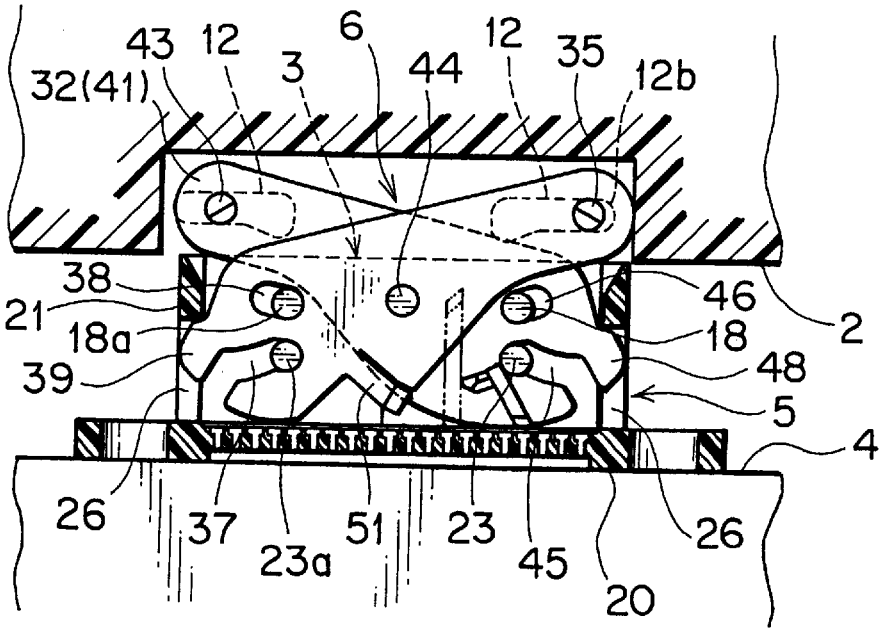
FIG. 21 is a view for explaining a state wherein the second connector is engaged with the first connector slightly offset to the right, and the engaging projections of the first operating lever and the second operating lever are engaged with the elongated lever locking holes.
Figure 22:
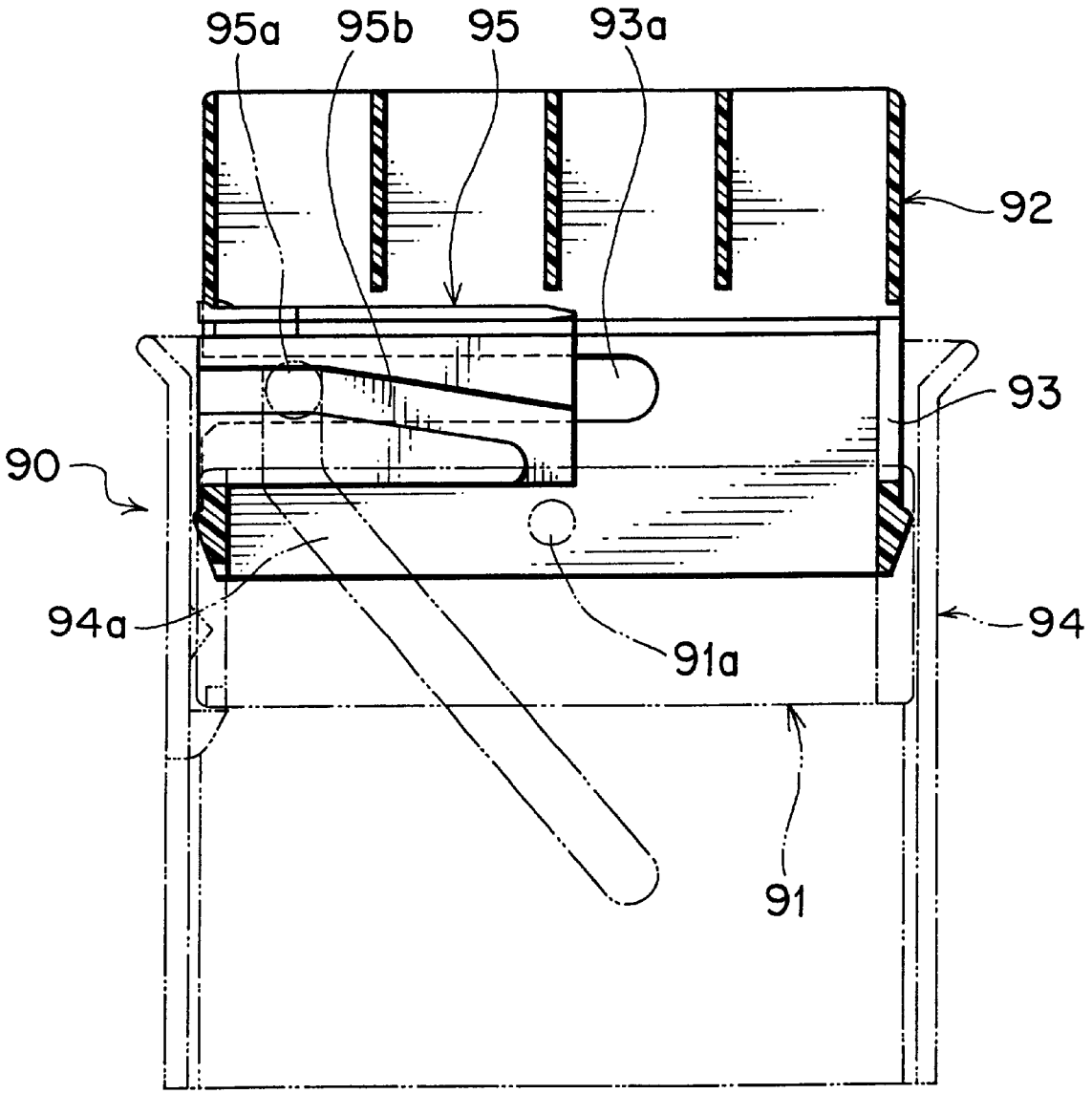
FIG. 22 PRIOR ART
FIG. 22 shows a conventional structure before a first connector housing and a second connector housing are engaged with each other.
Figure 23:
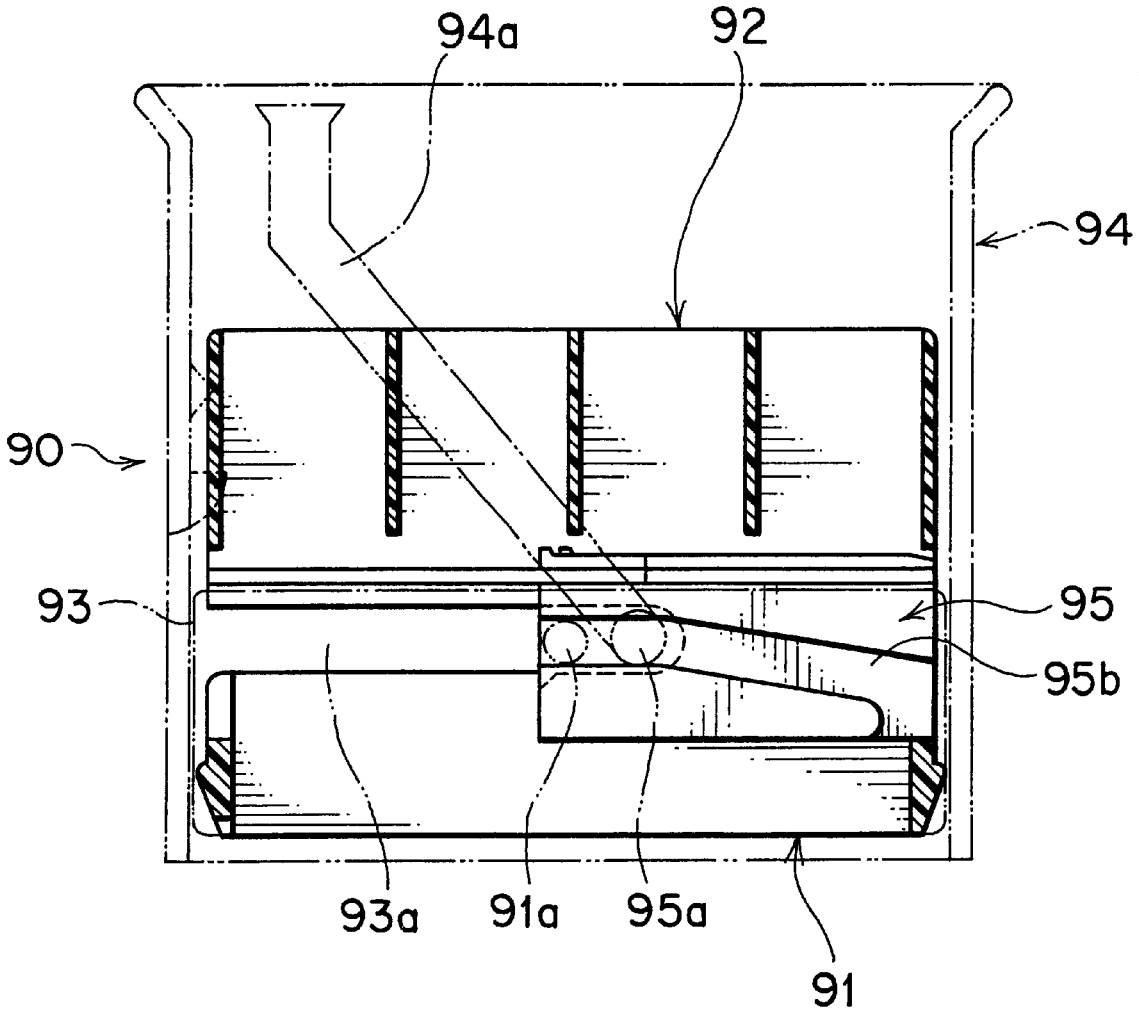
FIG. 23 PRIOR ART
FIG. 23 is a view for explaining a state wherein the first connector housing and the second connector housing of FIG. 22 are engaged with each other.

As shown in FIG. 20, after the vehicle side connector 3 and the apparatus side connector 5 have been engaged, the cam pins 23, 23*a* arrive at the inner end parts 37*c,* 45*c* of the cam grooves 37, 45, and the engaging projections 39, 48 of the first and the second operating levers 31, 32 are locked in the elongated locking holes 26, 26 of the apparatus side connector 5. Respective one ends of the first and the second operating levers 31, 32 are completely contained in the fitting hole 11. At this moment, the engaging pins 18, 18*a* have arrived at the end parts 38*b*, 46*b* of the elongated cam guide holes 38, 46 as shown in FIG. 21, or have not arrived according to cases.

In order to release the engagement between the vehicle side connector 3 and the apparatus side connector 5, the apparatus side connector 5 is extracted in an opposite direction to the engaging direction. The follower pins 35, 43 of the engagement operating cam member 6 move toward the starting parts 12*a*, 12*a* in the elongated cam guide holes 12,12, and the engaging pins 18, 18*a* are moved from the end parts 38*b*, 46*b* toward the starting parts 38*a*, 46*a* respectively. Accordingly, the engaging projections 39, 48 are released from the engagement with the elongated lever locking holes 26, 26.

Further extracting the apparatus side connector 5, the elastic arm 51 of the first operating plate 33 overrides the locked projection 52 along the inclined release face 52*a* of the locked projection 52 from the inclined arm guide face 52*b*. The elastic arm 51 and the locking projection 51*a* are provisionally locked with the locked projection 52 and the distal end 53*a* of the engaging rib 53 respectively. Because the cam pins 23 ,23*a* are opposed with the cam introducing grooves 37, 45, by pulling the apparatus side connector 5 straightly, the apparatus side connector 5 is released from the engagement operating cam member 6.

As described above, the vehicle side connector 3 and the apparatus side connector 5 can be engaged with the low insertion force by means of the cam mechanism, and the moving stroke of the apparatus side connector 5 can be shortened by means of the lever crank mechanism. Because the moving stroke of the apparatus side connector 5 can be shortened, both the connectors can be down-sized. The number of the components in the whole can be reduced as compared with the conventional structure. Therefore, the structure can be simplified and force increasing effects can be enhanced.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A coupling structure of connectors which comprises;

a fitting hole formed in a support body, a first connector adapted to be provided on a flux of electric wires extending through said fitting hole, a second connector directly fitted to a mount body, and an engagement operating cam member rotatably mounted on either one of said first connector and said second connector and adapted to engage said first connector with said second connector by means of a cam mechanism, and to be inserted into said fitting hole by sliding in a direction intersecting a direction of the engagement by means of a lever crank mechanism.

2. The coupling structure of the connectors as claimed in claim 1, wherein said engagement operating cam member consists of a first operating lever, and a second operating lever which is rotatably mounted on said first operating lever and combined thereto, said first and second operating levers are provided with follower pins rotatably and slidably engaged with an inner wall of said fitting hole at their respective one ends, and at their respective other ends are provided with elongated cam rotating holes in which engaging pins of one of said connectors are movably engaged, and cam grooves in which cam pins of said other connector are introduced.

3. The coupling structure of the connectors as claimed in claim 2, wherein the inner wall of said fitting hole is provided with a pair of elongated cam guide holes which are respectively engaged with said follower pins of said first and said second operating levers in a direction intersecting the direction of said engagement, backlash absorbing grooves for absorbing a backlash of said engagement operating cam member which has the backlash are formed in said elongated cam guide holes directed toward said mount body near positions where said follower pins are located at a start of the engagement, and posture correcting slanted faces for pressing said one connector are provided on a housing body of said other connector so as to conduct centering adjustment of said one connector having the backlash.

4. The coupling structure of the connectors as claimed in claim 2 or 3, wherein outer levers of the combined first and second operating levers are provided with integral elastic arms so that said first operating lever and said second operating levers may be provisionally locked in a state where said cam pins and cam introducing grooves of said cam grooves are opposed, said elastic arms are respectively provided with locking projections at distal ends thereof, and inner levers are provided with locked projections opposing said locking projections.

5. The coupling structure of the connectors as claimed in claim 4, wherein lock release plates are provided in a housing body of said other connector extending in a direction of the engagement for releasing a provisional engagement between said locking projections and said locked projections when said cam pins are introduced into said cam introducing grooves.

6. The coupling structure of the connectors as claimed in any one of claims 1 to 3, wherein engaging projections are provided at peripheral edges of other ends of said first and said second operating levers to fix said engagement operating cam member after completion of the engagement, and said housing body of said other connector is provided with elongated lever locking holes to be locked with said engaging projections when said cam pins have arrived at inner end parts of said cam grooves.

* * * * *